United States Patent [19]

Gerum

[11] 4,016,562

[45] Apr. 5, 1977

[54] SWITCH-OFF DEVICE FOR ELECTRICALLY OPERATED CLOCK ALARM AND CONTROL THEREFOR

[75] Inventor: Erich Gerum, Nurnberg, Germany

[73] Assignee: DIEHL, Nurnberg, Germany

[22] Filed: June 2, 1975

[21] Appl. No.: 582,908

[30] Foreign Application Priority Data

June 7, 1974 Germany ..... 2427589

[52] U.S. Cl. ..... 340/384 E; 340/309.1; 58/38 R

[51] Int. Cl.[2] ..... G08B 3/10

[58] Field of Search ..... 58/38 R; 340/384 E, 340/384 R, 309.1, 309.4

[56] References Cited

UNITED STATES PATENTS

| | | | |
|---|---|---|---|
| 3,533,226 | 10/1970 | Bach-y-Rita | 58/38 X |
| 3,545,195 | 12/1970 | Krischker | 58/38 X |
| 3,589,123 | 6/1971 | Flaig | 58/38 R |
| 3,728,855 | 4/1973 | Preiser | 58/38 R |

*Primary Examiner*—Harold I. Pitts
*Attorney, Agent, or Firm*—Walter Becker

[57] ABSTRACT

An electrically operable alarm provided for a clock and includes a clock operated switch for turning the alarm on at a selected time. The electrically operable alarm includes an oscillatory circuit which, when oscillating, causes the alarm to sound and when not oscillating, causes the alarm to be silent. A bistable sweep circuit is operatively connected to the oscillatory circuit and goes to a first condition when the clock operated switch closes and in which condition the alarm sounds. A manual switch is provided which, when open momentarily, will cause the bistable switching circuit to go to a second condition in which the alarm remains silent until the clock operated switch again closes the next day. The manual switch is adjustable for preventing the alarm from sounding when the clock operated switch closes.

6 Claims, 2 Drawing Figures

SWITCH-OFF DEVICE FOR ELECTRICALLY OPERATED CLOCK ALARM AND CONTROL THEREFOR

BACKGROUND OF THE INVENTION

The present invention relates to a switch-off device for a battery operated alarm clock with an alarm contact and an alarm sounding device operable thereby. It has been suggested to provide a bistable sweep circuit with a switch-off key, which sweep circuit responds to the actuation of the switch-off key and stores the switch-off signal for the alarm sounding device, at least up to the time the alarm contact opens. Such switch-off device is intended while saving mechanically expensive structures so to design the alarm clock that it sounds off every 24 hours. This means that the switching-off operation for the alarm signal, which operation is effected by the user of the alarm clock has to be extinguished prior to the alarm signal sounding off on the next day. With alarm clocks of this type the further requirement has to be met that the alarm sounding device must also be adapted to be switched off for a plurality of days.

SUMMARY OF THE INVENTION

It is, therefore, an object of the present invention to provide a switch-off device for a battery operated alarm clock with an alarm contact and with an electric alarm sounding device operable by said alarm contact. The said alarm sounding device is preceded by a bistable sweep circuit which when closing the alarm contact occupies that one condition in which the alarm sounding device is ready for an operation, while said alarm sounding device by actuation of a control element occupies a second condition in which the alarm sounding device is blocked while the switching-off of the alarm signal for one day which is automatically extinguished as well as the continuous switching off is effected by means of a single control element.

BRIEF DESCRIPTION OF THE DRAWINGS

These and other objects and advantages of the invention will appear more clearly from the following specification, in connection with the accompanying drawings, in which.

DESCRIPTION OF THE PREFERRED EMBODIMENT

The switch-off device for a battery operated alarm clock according to the present invention is characterized primarily in that the switch element is arranged in a branch of the sweep circuit and that a brief braking of the branch by means of the switch element brings about the second control condition of the sweep circuit and maintains this second condition at least until the alarm contact opens. The switch-off device according to the invention is furthermore characterized in that with a continuous interruption or braking of said branch by means of the switch element, the second control condition of said sweep circuit remains maintained even after the alarm contact has been closed. The essential advantage in this connection is seen in the fact that the two switch-off operations which respond to different conditions are adjustable by a single control or switch element. For purposes of switching off of the alarm sounding device for the respective day, the switch element is only briefly actuated, whereby the branch of the sweep circuit which comprises said switch element is briefly interrupted or broken. The sweep circuit will then adopt its second control condition in which the alarm sounding device is blocked. In this instance during the next closing of the alarm contact, the sweep circuit is brought into its first control condition whereby the alarm sounding device again will be ready for operation. For purposes of permanently turning off the alarm sounding device for a plurality of days, the branch of the sweep circuit is held continuously in broken condition by means of the control element.

Advantageously, preferably as control element there is selected a mechanical switch which interrupts a contact located in the branch of the sweep circuit. The switch is adapted to be keyed, preferably for a brief interruption of the contact and is also rotatably adjustable for a permanent braking of the circuit.

As sweep circuit there is provided a bistable multivibrator with two transistors while the collector of each transistor is coupled to the base of the other transistor and between the base of one transistor and the alarm contact there is located a condenser. The control element is, in this connection, preceded by the collector of the other transistor.

Figure 1:
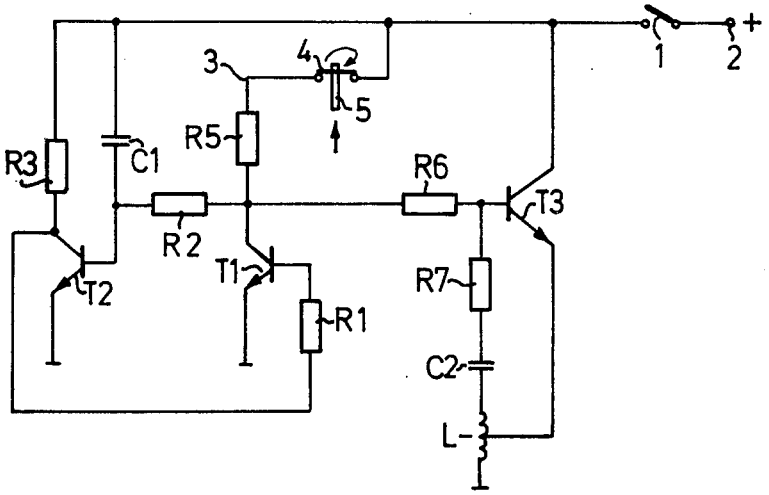
FIG. 1 illustrates a circuit for a switch-off device according to the invention.

Referring now to the drawings in detail, the circuit shown in FIG. 1 comprises an alarm contact 1 which on one hand is connected to a terminal 2 for the battery, and on the other hand is connected to a sweep circuit. The sweep circuit comprises two transistors T1 and T2. The base of the transistor T1 is connected by a resistor R1 to the collector of the transistor T2. The base of the transistor T2 is through a resistor R2 connected to the collector of the transistor T1. The emitter of the transistors T1, T2 are connected to the other terminal. Between the collector of the transistor T2 and the alarm contact there is provided a resistor R3. The base of the transistor T2 is through a condenser C1 likewise connected to the alarm contact. In a branch 3 of the sweep circuit which extends from the collector of the transistor T1 to the alarm contact, there is provided a resistor R5 and contacts 4 which are adapted to be bridged by a switch 5. The collector of the transistor T1 represents the exit of the sweep circuit. Connected to said sweep circuit through the intervention of a resistor R6 is the base of a transistor T3. Ahead of said base of this transistor there is furthermore provided a resistor R7 and an oscillatory circuit (Schwingschaltung) comprising a condenser C2 and a coil L. The emitter of the transistor T3 is connected to a tap of the coil, whereas its collector is connected to the alarm contact. Coil L may be magnetically coupled to an armature which produces an audible alarm signal when vibrating.

The alarm contact is mechanically coupled to the clock mechanism of the alarm clock. It closes every 24 hours at the alarm time set on the alarm clock and opens again about half an hour later.

The switch 5 is so designed that it can be used by the user in two different manners. When keying the switch, the branch 3 is briefly interrupted and subsequently closed again. When turning the switch by about 90° the branch 3 remains interrupted until the switch has turned by another 90°.

The way of operation of this switch-off device is as follows:

If the switch 5 is closed, which means occupies the position shown in FIG. 1, and if the alarm contact 1 is closed, the transistor T2 is, by means of the condenser C1, switched so as to be conductive. The transistor T1 is blocked by the resistor R1. The necessary base current for maintaining this switch condition for the transistor T2 flows through the switch 5 and the resistors R5 and R2. In this way the transistor T3 becomes conductive, and the oscillations now occurring in the coil L are processed for generating an acoustic alarm sounding signal.

If it is intended to switch off the alarm signal for the respective day, the switch 5 is briefly keyed. As a result thereof, the branch 3 is briefly interrupted. This interruption brings about that due to the switching off of its base current, the transistor T2 is blocked. Consequently, the base of the transistor T1 is saturated through resistors R3, R1. The transistor T1 is conductive. As a result thereof, the transistor T3 is blocked and after closing the contact 4 remains blocked. The transistor T3 becomes conductive again only when the next day the alarm contact 1 is closed and thereby the transistor T2 is switched through.

If the alarm sounding device is to remain in switched-off condition for a plurality of days the switch 5 is opened by turning it by 90°. If this occurs at a time at which the alarm signal sounds, the signal will be immediately interrupted. During the next closing of the alarm contact, the transistor T2 becomes briefly conductive through the condenser C1, but this condition cannot be retained because the transistor T2 will not receive any base current through switch contacts 4 and the resistors R5 and R2.

Figure 2:
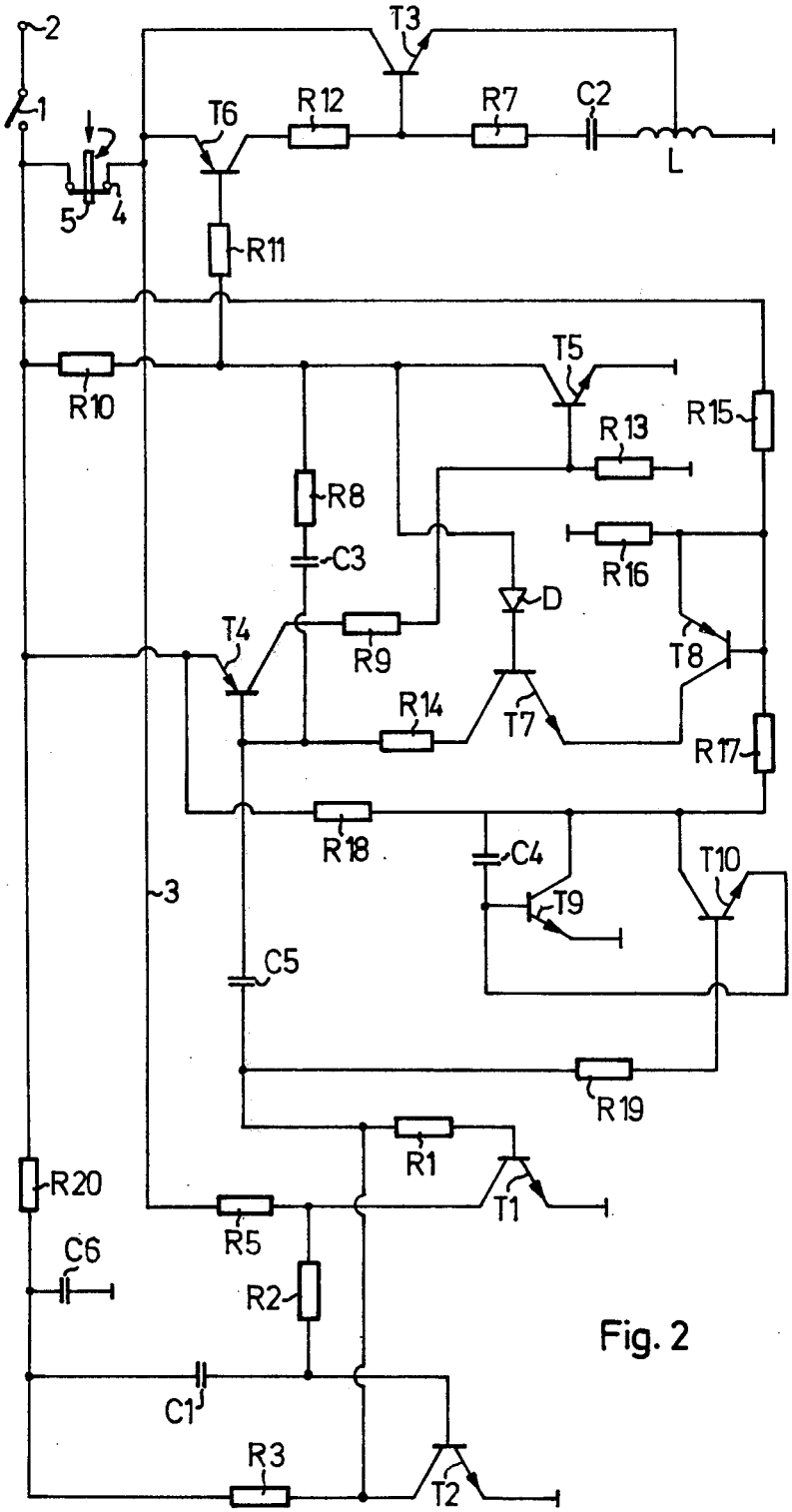
FIG. 2 represents a circuit for an improved alarm sounding device according to the invention.

FIG. 2 shows a special alarm sounding device according to which the alarm signal is composed of sound pulses which are automatically switched off and after a few minutes are again switched on.

For purposes of generating the pulse sequence, an astable pulse generator with transistors T4, T5 is provided while the base of the transistor T4 is through the intervention of an RC-member R8, C3 coupled to the collector of the transistor T5, the base of which is through a resistor R9 connected to the collector of the transistor T4. The collector of the transistor T5 is through the resistor R10 connected to the alarm contact 1 and represents the exit of this circuit part. Connected thereto through a resistor R11 is a driver transistor T6, the emitter-collector distance of which, is with a resistor R12 arranged in parallel to the collector base distance of the transistor T3. The base of the transistor T5 is preceded by a biasing transistor R13.

Furthermore, with the pulse generator there is provided a transistor T7. Its collector-base distance with resistor R14 and a diode D are arranged in parallel to the resistor R8 and the condenser C3. Connected to the emitter of the transistor T7 is the collector of a transistor T8, the emitter of which, is arranged between resistors R15, R16 forming a voltage divider. The base of the transistor T8 is through a resistor R17 connected to a condenser C4.

The condenser C4 is preceded by a charging resistor R18. Arranged in parallel to the condenser C4 is on one hand, the collector-base distance of a transistor T9, and on the other hand the collector-emitter distance of a control transistor T10. The base of the control transistor T10 is through a resistor R19 connected to the collector of the transistor T2. The base of the transistor T4 is by means a further condenser C5 coupled to the collector of the transistor T2.

The sweep circuit illustrated in FIG. 1 is also provided in FIG. 2. Its structural elements are provided with the same reference numerals as in FIG. 1. Between the sweep circuit and the alarm contact 1 there is additionally provided a filter section comprising a resistor R20 and a condenser C6. This filter section is intended to keep interfering pulses away from the sweep circuit. Instead of the filter section, also a current constant holding circuit may be provided.

The function of this alarm sounding device is as follows: Assuming that the alarm contact 1 as well as the switch 5 is closed, it will be appreciated that the battery voltage is connected to all circuit elements of the alarm sounding device. The transistor T2 is conductive, and the transistor T10 is blocked.

The condenser C4 and the transistor T9 operate in the manner of a Miller-integrator. The condenser C4 will gradually charge itself up when the alarm contact is closed. The charging current generated in this connection represents a base current for the transistor T9, which base current makes said transistor conductive. When the voltage to the condenser C4 exceeds a certain threshold value, the transistor T8 becomes conductive. It works as a controllable resistor and controls the transistor T7 at the emitter thereof. The transistor T7 becomes conductive always when the transistor T5 is blocked. The transistor T4 becomes conductive when the transistor T7 is driven hard (durchgesteuert ist) when the condenser C3 is charged. As a result thereof, also transistor T5 becomes conductive.

The driver transistor T6 becomes conductive when the transistors T4 and T5 are switched through. The pulses which control the driver transistor T6 last a few seconds. Similarly, the pulse intervals are within the range of seconds.

In the course of a further charging of the condenser C4, in view of the decreasing charging current, the transistor T9 becomes less and less conductive. Due to the increase in the voltage occurring in connection therewith on the condenser C4, the base current passing through the resistor R17 into the transistor T8 operating as a controllable resistor has its resistance decrease. This brings about ever decreasing pulse intervals of the astable pulse generator which comprise in particular the transistors T4 and T5.

If the alarm signal is to be switched off for the respective day, the switch 5 is briefly keyed. As a result thereof, the base current of the transistor T2 is interrupted so that it blocks. In this way, the transistor T10 becomes conductive and discharges the condenser C4 so that the transistor T8 is blocked and remains blocked until the battery voltage by opening the alarm contact 1 is separated from the circuit. If the alarm signal is to be interrupted for a plurality of days, the switch 5 is so actuated that it remains continuously open. This was described in detail above.

The particular advantages of the invention consist in that for the various switch-off functions only one single control element 5 is required and that the latter has to interrupt only one single contact 4 in the branch 3. This brings about a considerable saving in the mechanical construction of the alarm clock, especially when the alarm sounding device employs an integrated circuit. At the same time, the employment of only a single control element represents a considerable simplification of the operation.

It is, of course, to be understood that the present invention can be used in numerous other circuits for alarm clocks. It is possible to connect the switch directly to the terminal 2 for the battery.

It is, of course, also to be understood that the present invention is, by no means, limited to the specific showing in the drawings, but also comprises any modifications within the scope of the appended claims.

What is claimed is:

1. In an electrically operable alarm for a clock having first and second switches as well as a source of power therewith; an oscillatory circuit activatable by the first switch of the clock at a selectable time and operable when oscillating to cause the alarm to sound, a bistable switching sweep circuit having at least one branch and connected between one side of the source of electric power and said oscillatory circuit and having a first condition in which said oscillatory circuit is operable to oscillate when the first switch is closed and having a second condition in which said oscillatory circuit does not oscillate in response of the operation of the second switch, the improvement therewith comprising in combination: the second switch being connected in one branch of said bistable switching sweep circuit, means for momentarily opening said second switch causing said bistable switching circuit to go to said second condition and to stay in said condition until the first switch is opened and further means for permanently opening said second switch causing said bistable switching sweep circuit to stay in said second condition when said first switch is closed.

2. An electrically operable alarm in combination according to claim 1 in which said second switch is a manual switch and in closed position interconnects a pair of contacts in said sweep circuit while in open position disconnects said contacts.

3. An electrically operable alarm in combination according to claim 2 in which said second switch has an actuating element therein which can be depressed for momentarily opening the switch and which can be rotated for holding the switch open.

4. An electrically operable alarm in combination according to claim 3 in which said sweep circuit is a transistorized bistable circuit having first and second transistors each having base, collector and emitter terminals, the collector of each transistor being coupled via a resistor to the base of the other transistor, a capacitor connected between the base of said first transistor and the side of said first switch opposite said source, the emitters of said transistors being connected to the other side of said source, and said second switch being connected via a resistor between the collector of said second transistor and the side of said first switch opposite said source.

5. An electrically operable alarm in combination according to claim 4 which includes a transistorized pulse generating circuit connected to said sweep circuit operable to cause said alarm to sound reiteratively when the said sweep circuit goes to said first condition thereof.

6. An electrically operable alarm in combination according to claim 5 which includes a control transistor in series with said oscillatory circuit, said pulse generating circuit being connected to the base of said control transistor and cyclically controlling the conductivity of the control transistor thereby to control the supply of energy to said oscillatory circuit and thereby the sounding of the alarm.

* * * * *